US005886593A

United States Patent [19]

Andoh et al.

[11] Patent Number: 5,886,593

[45] **Date of Patent: *Mar. 23, 1999**

[54] DIELECTRIC RESONATOR DEVICE

[75] Inventors: Masamichi Andoh, Nagaokakyo; Taiyo Nishiyama, Takatsuki, both of Japan

[73] Assignee: Murata Maufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 739,863

[22] Filed: Oct. 31, 1996

[30] Foreign Application Priority Data

Nov. 1, 1995 [JP] Japan ..... 7-285279

[51] Int. Cl.[6] ..... H01P 1/20; H01P 7/10

[52] U.S. Cl. ..... 333/202; 333/219.1

[58] Field of Search ..... 333/125–128, 333/134, 202, 203, 208–212, 219, 219.1, 227, 230

[56] References Cited

U.S. PATENT DOCUMENTS 4,937,533 6/1990 Livingston ..... 333/203 X 5,151,670 9/1992 Blair et al. ..... 333/126

5,604,471 2/1997 Ráttilá et al. ..... 333/202

FOREIGN PATENT DOCUMENTS 0209878 1/1987 European Pat. Off. ..... 333/202

*Primary Examiner*—Seungsook Ham

*Attorney, Agent, or Firm*—Ostrolenk, Faber, Gerb & Soffen, LLP

[57] ABSTRACT

A coupling loop, formed by a bendable sheet material, formed by a main plate and two branch plates, with the main plate provided with a phase adjustor. The coupling loop can be easily bent in the direction of its thickness, thereby facilitating coupling adjustments and reducing the load exerted on the connecting and fixing portions of the sheet material of which the coupling loop is composed. The coupling loop allows excellent workability and processability to be achieved, is lower in cost, and allows external coupling adjustments to be performed readily, without any problems occurring in the connecting and fixing portions of the coupling loop.

32 Claims, 3 Drawing Sheets

DIELECTRIC RESONATOR DEVICE

BACKGROUND OF THE INVENTION

1. Field of the Invention

The present invention broadly relates to a dielectric resonator device, and, more particularly, to a structure of a dielectric resonator device which allows an external coupling of a dielectric resonator to be performed readily, and excellent workability and processability to be achieved.

2. Description of the Related Art

FIG. 4 is a side elevational view which schematically shows a structure of an external coupling of a dielectric resonator.

As illustrated in FIG. 4, in the structure, a coupling loop 59, composed of a metallic wire connected to an external connector 58, is externally coupled to a dielectric column 60. More specifically, when an electrical current E is allowed to flow in the coupling loop 59 in the direction of the arrows, a magnetic field M is generated around an axis defined by the coupling loop 59. The generated magnetic field M causes the coupling loop 59 and the dielectric column to be coupled together. Here, the degree of coupling of the coupling loop 59 and the dielectric column 60 depends on such factors as the thickness of the metallic wire making up the coupling loop 59, the size of the coupling loop 59, the distance between the coupling loop 59 and the dielectric column 60, and the like.

FIGS. 5(A) and 5(B) each illustrate an example of a dielectric resonator device using the dielectric resonator shown in FIG. 4.

FIG. 5(A) is a plan view of the internal construction of the dielectric resonator device, without the upper portion of the case. FIG. 5(B) is a side elevational view thereof.

As shown in FIGS. 5(A) and 5(B), six dielectric resonators, R1 to R6, are contained in a case 30. The first three dielectric resonators R1 to R3 form a receiving bandpass filter, while the last three dielectric resonators R4 to R6 form a transmitting bandpass filter. External connectors 31 to 33 are provided on the side faces of the case 30. Coupling loops 34 and 35 are provided between the central conductor of the external connector 32 and the case 30, and between the central conductor of the external connector 33 and the case 30, respectively. The case 30 serves as a ground. The coupling loops 34 and 35 are magnetically coupled to the dielectric resonators R1 and R4, respectively.

FIG. 3 is a partial perspective view of the structure of the region around the external connector 31. As illustrated in FIG. 3, a central conductor 31*a* of the external connector 31 is connected to the coupling loop 21.

The coupling loop 21 is formed by a main wire 22 and four branch wires 23. The main coupling of the coupling loop 21 to the dielectric resonators R3 and R6 is performed through the four branch wires 23.

The main wire 22 is provided with two phase adjustors 24. The central conductor portion 31*a* of the external connector 31 is soldered at 26 to the center of the main wire 22. Each end of the main wire 22 is connected and fixed to the case 30, serving as ground, via terminals such as solderless terminals 27 or the like which are then screwed to a grounded mounting post.

When the coupling loop 21 is magnetically coupled to the dielectric resonators R3 and R6, the two phase adjustors 24 adjust the phase of the dielectric resonator R3 and the central conductor 31*a*, and the phase of the dielectric resonator R6 and the central conductor 31*a*, respectively. The two phase adjustors 24 adjust an electrical length from the central conductor 31*a* to the dielectric resonator R3 and an electrical length from the central conductor 31*a* to the dielectric resonator R6, whereby the two phase adjustors 24 adjust the phase of the transmitter and the phase of the receiver. The phase adjustors 24 are thought to adjust the phase of the dielectric resonator R3 and the central conductor 31*a*, and that of the dielectric resonator R6 and the central conductor 31*a*, respectively, when the equivalent inductive components of the phase adjustors 24 are introduced in parallel with the four branch wires 23 which are used for the main coupling of the coupling loop 21 with the resonators R3 and R6, and the branch wires 23 and the dielectric resonators R3 and R6 are coupled together.

The center of the main wire 22 is supported by two cylindrical bushings 28 made of fluororesin.

The four branch wires 23 are C-shaped. A projecting end of each of the C-shaped branch wires 23 is inserted in a hole formed in the main wire 22 and soldered thereto, while the other end of each branch wire 23, provided with one of the solderless terminals 27, is connected and fixed to the case 30, serving as ground, along with the ends of the main wire 22.

The coupling of the coupling loop 21 with the dielectric resonators R3 and R6 is adjusted using an adjusting jig, with the upper portion of the case 30 removed, or through a hole for receiving the adjusting jig into the case 30. Here, the adjustment is performed using the adjusting jig by bending the branch wire 23 of the coupling loop 21 such that the loop 21 approaches the case 30 (that is, moves away from the dielectric resonators R3 and R6), or by bending the branch wire 23 such that the loop 21 approaches the dielectric resonators R3 and R6 (that is, moves away from the case 30). In other words, the adjustment is performed by moving the branch wires 23.

Conventional coupling loops are formed by metallic wires, with a hole formed in a main wire of the coupling loop for inserting an end of a branch wire therethrough and soldering the branch wire thereto. However, it is extremely difficult to form such a hole in a thin metallic wire, making it very troublesome to produce the coupling loop.

Even when the coupling loops are constructed such that they can be externally coupled to a desired degree, the coupling loops vary slightly in form after they are constructed, and variations occur in the degree of external coupling of the dielectric resonator devices, thus requiring large adjustments of the coupling loops.

In addition, many component parts are used, including a main wire having a portion for coupling to the central conductor of the external connector and having two phase adjustors, four branch wires, a bushing for supporting the main wire, and a solderless terminal for being screwed to a ground.

Further, since the coupling loop is formed by a metallic wire, the metallic wire must be shaped into a desired form after it has been formed to a proper length, thus making it very troublesome to produce the coupling loop.

This has made it more expensive to produce a dielectric resonator device.

Further, since an adjusting jig is used to adjust the degree of external coupling by moving the branch wire, a load is exerted on a soldered connecting portion of the coupling loop, resulting in peeling of the solder or removal of the end of the inserted metallic wire, so that the characteristics of the coupling loop are changed from their predetermined value, leading to the possibility of deviations in the characteristics of the entire dielectric resonator device from the desired characteristics.

SUMMARY OF THE INVENTION

Accordingly, an object of the present invention is to provide a dielectric resonator device that allows excellent workability and processability to be achieved, is lower in cost, and has a coupling loop whose external coupling can be easily adjusted, without any problems occurring in any of the connecting portions of the coupling loop.

To this end, according to an aspect of the present invention, there is provided a dielectric resonator device, comprising: a case; a dielectric resonator contained in the case; an external connector mounted to the case; and a coupling device connected to the external connector and coupled to the dielectric resonator; wherein a portion of the coupling device is bent to form an adjusting mechanism for adjusting the coupling of the coupling device to the dielectric resonator, and wherein at least the adjusting mechanism of the coupling device is composed of a bendable sheet material.

Accordingly, punching or etching a metallic sheet allows the desired shape to be easily obtained. In addition, since the sheet has a certain width, it is relatively easy to form a hole in a connecting and fixing portion when constructing the coupling loop. Further, the thickness of the sheet material is smaller than its width, thereby allowing it to be bent relatively easily in the direction of thickness.

According to another aspect of the present invention, an easily bendable portion is formed at a predetermined portion of the adjusting mechanism of the coupling device.

The easily bendable portion allows the coupling device to be easily bent at the predetermined portion thereof.

BRIEF DESCRIPTION OF THE DRAWINGS

FIG. 5(A) is a plan view of the internal structure of the conventional dielectric resonator device, while

DETAILED DESCRIPTION OF EMBODIMENTS OF THE INVENTION

Figure 1:
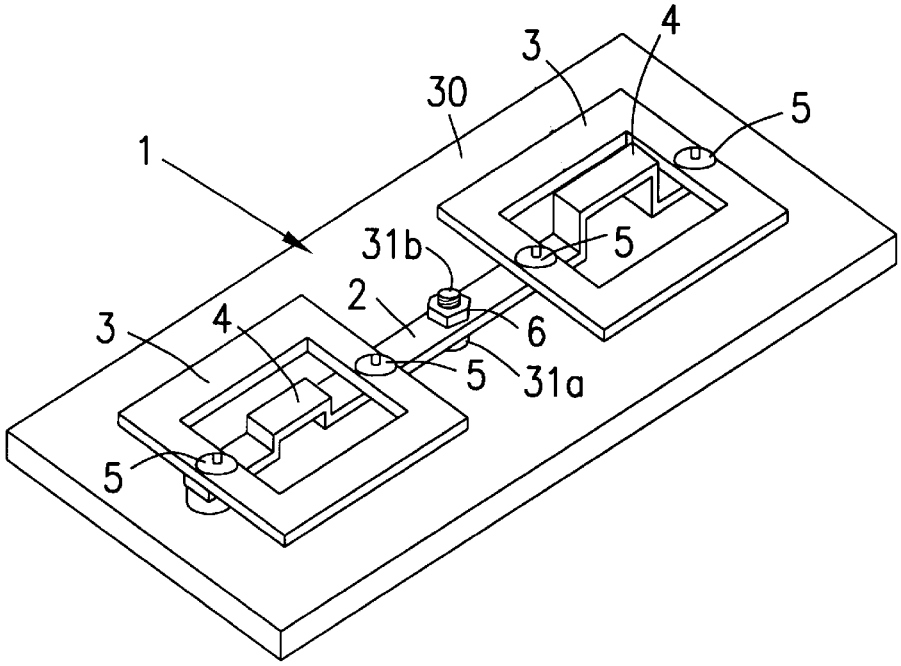
FIG. 1 is a perspective view of an external coupling portion a dielectric resonator device in accordance with embodiment of the present invention.

A description will now be given of dielectric resonator devices in accordance with two embodiments of the present invention.

The overall structure of the dielectric resonator device is similar in some respect to that of the conventional dielectric resonator device shown in FIGS. 5(A) and 5(B), so parts similar to those of the conventional dielectric resonator device will be given the same reference numerals, and will not be hereunder described in detail.

Figure 5A:
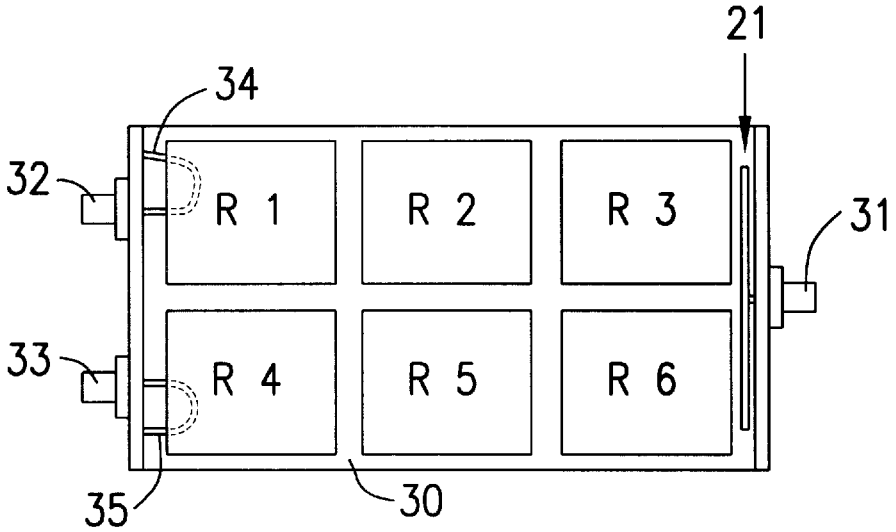
FIG. 5A PRIOR ART
Figure 5B:
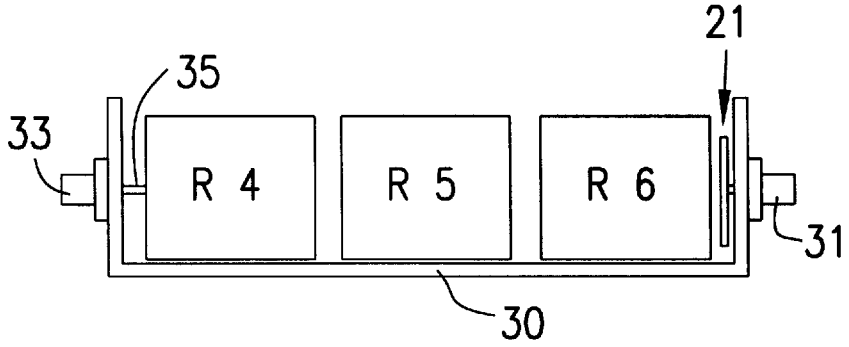
FIG. 5B PRIOR ART
FIG. 5(B) is a side elevational view thereof.

FIG. 1 is a perspective view of the structure of the region around the external connector 31 illustrated in FIGS. 5(A) and 5(B). As illustrated in FIG. 1, the central conductor 31*a* of the external connector 31 is secured and connected to the coupling loop 1.

The coupling loop 1 is formed by a main plate 2 and two branch plates 3, with the branch plates 3 being used for the main coupling of the coupling loop 1 to dielectric resonators R3 and R6.

The main plate 2 has a hole formed at about the center thereof for passage of the central conductor 31*a* of the external connector 31. An end of the central conductor 31*a* of the external connector 31 is formed into an externally threaded section 31*b* with a smaller diameter than the diameter of the central conductor portion 31*a*. The main plate 2 and the central conductor portion 31*a* of the external connector 31 are connected and fixed together by inserting the externally threaded section 31*b* into the hole of the main plate 2, and then screwing a nut 6 onto the externally threaded section 31*b* (forming the end of the central conductor portion 31*a*) that projects out from the hole in order to secure the main plate 2 to the externally threaded section 31*b*.

In addition, the main plate 2 is provided with two phase adjustors 4 which are unequal in length for adjusting the respective phases of their corresponding dielectric resonators and the central conductor 31*a* of the external connector 31, when the coupling loop 1 and the dielectric resonators R3 and R6 are magnetically coupled together. The phase adjustors 4 are thought to adjust the phase between the central conductor 31*a* of the external connector 31 and the dielectric resonator R3, and that between the central conductor 31*a* and the dielectric resonator R6, respectively, when the inductive components are equivalently introduced so as to be in parallel to the branch plates 3 which are used for the main coupling of the coupling loop 1 with the dielectric resonators R3 and R6, or when the branch plates 3 and the dielectric resonators R3 and R6 are coupled together.

The main plate 2 has four holes formed therein, in addition to the center hole, such that the two phase adjustors 4 are interposed between the holes. When screws 5, for example, are screwed into the holes, the main plate 2 is not only connected to the two branch wires 3, but is also connected and fixed to a case 30, serving as ground.

The two branch plates 3 are formed by molding large blank sheets into a square or rectangular shape, with holes formed at about the center of the two edges, opposing each other, of the square shape. The two branch plates 3 are connected and fixed to the main plate 2 by placing the holes in the branch plates 3 onto the holes of the main plate 2 and screwing the screws 5 into these holes that have been aligned together.

In the conventional dielectric resonator device, the coupling of the coupling loop 21 to the dielectric resonators R3 and R6 is adjusted using an adjusting jig, with the upper portion of the case 30 removed, or through a hole for inserting the adjusting jig into the case 30, by bending the branch wires 23 as discussed above.

In the present embodiment, a sheet material is used to produce the coupling loop 1, thereby making it easier to perform processing and molding in producing the coupling loop 1. In addition, the sheet material can be easily bent in the direction of thickness because its thickness is smaller than its width. In other words, the branch plates can be easily moved with respect to the corresponding resonators.

Further, since the branch plates 3 are formed by molding the sheet into a square or rectangular shape, only two quadrangular-shaped members are required, compared to four C-shaped members conventionally required to produce the branch wires.

Still further, the externally threaded section 31*b* forming an end of the central conductor 31*a* of the external connector 31 has a smaller diameter than the central conductor 31*a*, so that when the central conductor 31*a* is inserted into the hole in the center of the main plate 2 of the coupling loop 1, the main plate 2 is supported on a step formed at the boundary of the externally threaded section 31*b* of the center conductor 31*a* and the rest of the center conductor 31*a*. More specifically, it is no longer necessary to use a supporting member made of resin, as has been conventionally the case.

Figure 2:
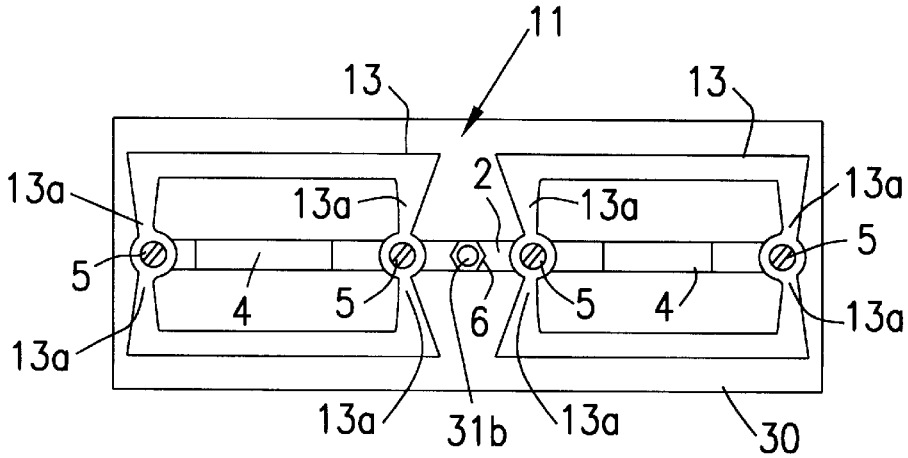
FIG. 2 is a plan view of a modification of an external coupling portion in accordance with another embodiment of the present invention.
Figure 3:
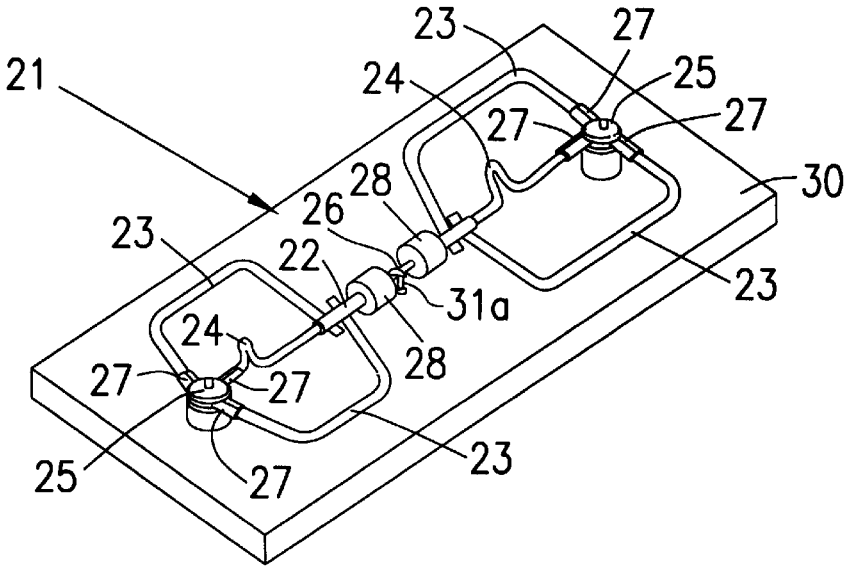
FIG. 3 PRIOR ART
FIG. 3 is a perspective view of an external coupling portion of a conventional dielectric resonator device.
Figure 4:
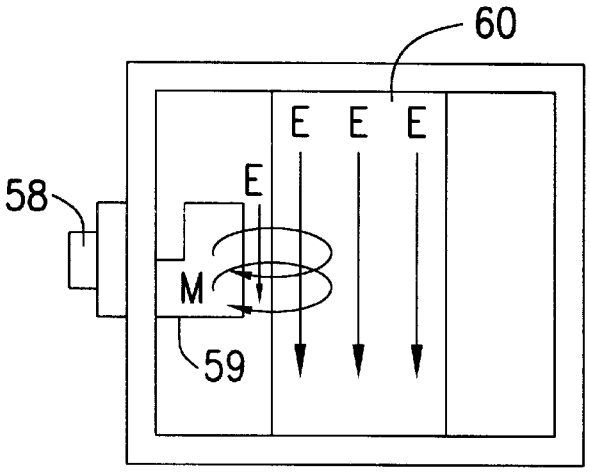
FIG. 4 PRIOR ART
FIG. 4 is a schematic cross-sectional view schematically illustrating the coupling of the external coupling portion and a resonator portion of the conventional dielectric resonator device.

FIG. 2 illustrates a modification of the external coupling portion of the dielectric resonator device in accordance with another embodiment of the present invention. The modified external coupling portion differs from that shown in FIG. 1 in that the branch plates of the coupling loop are shaped differently. In FIG. 2, similar component parts as those of the embodiment of FIG. 1 are given the same reference numerals and will not be described hereunder in detail.

As shown in FIG. 2, the holes are formed in portions of each branch plate 13 which have a larger width than the rest of the branch wire 13, with easily bendable portions 13*a* having a smaller width than the rest of the branch plate 13. The bendable portions 13*a* are formed at predetermined locations with respect to the corresponding holes (for example at each side of the hole).

Accordingly, since the holes are formed in wider portions of the branch plate 13, it is easier to form the holes than in the embodiment illustrated in FIG. 1. In addition, since the easily bendable portions 13*a* are formed at predetermined locations, the branch plate 13 can easily be bent at those locations in order to make coupling adjustments by moving the branch plate 13.

Although in the foregoing description, the easily bendable portion 13*a* has been described as having a smaller width, the present invention is not limited to such a construction. It may also be formed by forming only a predetermined portion of the branch plate 13 to a smaller thickness. That is, the easily bendable portion 13*a* may be formed in any way as long as the branch plate 13 can be easily bent at a predetermined portion thereof.

As can be understood from the foregoing description, according to the present invention, when the coupling loop of a coupling device is composed of a bendable sheet material, the coupling loop can be easily bent in the direction of thickness, thereby facilitating coupling adjustments and reducing the load exerted onto the connecting and fixing portions of the sheet material of which the coupling loop is composed. In addition, the branch plate of the coupling loop is easily deformed only in the direction toward and away from the resonators and is not easily deformed in the other directions, resulting in smaller variations in the degree of external coupling of the dielectric resonator devices, thus making it easier to perform adjustments, or in some cases eliminating the need for performing adjustments.

In addition, according to the present invention, it is possible to prevent deformations in and removal of an inserted wire from the connecting and fixing portions of the coupling loop, in order to prevent resulting changes in the characteristics of the coupling loop and thus of the dielectric resonator device.

Further, by virtue of forming the coupling loop using a sheet material, it is possible to improve its processability and reduce the number of component parts required, thereby reducing the cost for producing a coupling loop.

Further, since the coupling device can be easily bent at a predetermined portion thereof by forming an easily bendable portion at this predetermined portion with lower rigidity than the other portions of the coupling device, the load that is exerted on the connecting and fixing portions can be further reduced. Therefore, when such an easily bendable portion is formed, it is possible to prevent changes in the characteristics of the coupling loop caused by deformations in and removal of a wire from the connecting and fixing portion.

What is claimed is:

1. A dielectric resonator device, comprising:

a case;

a dielectric resonator contained in said case;

an external connector mounted to said case; and coupling means connected to said external connector and electromagnetically coupled to said dielectric resonator;

wherein said coupling means includes an adjusting mechanism for adjusting the electromagnetic coupling of said coupling means to said dielectric resonator, said adjusting mechanism being composed of a main coupling plate and a unitary loop-shaped branch plate separably attached thereto, said main and branch plates being made of a bendable sheet material for being bendable in order to adjust said coupling.

2. A dielectric resonator device according to claim 1, wherein said adjusting mechanism comprises a predetermined portion of said coupling means having less rigidity than other portions of said coupling means.

3. A dielectric resonator device according to claim 2, wherein said predetermined portion is smaller in width than said other portions of said coupling means.

4. A dielectric resonator device according to claim 2, wherein said predetermined portion is smaller in thickness than said other portions of said coupling means.

5. A dielectric resonator device according to claim 2, wherein said predetermined portion is located adjacent a portion of said coupling means which is fixed to said dielectric resonator device.

6. A dielectric resonator device according to claim 1, wherein said adjusting mechanism is disposed for enabling said coupling means to bend toward and away from said dielectric resonator.

7. A dielectric resonator device according to claim 1, wherein said dielectric resonator device has a step integrally formed thereon for supporting said coupling means.

8. A dielectric resonator device, comprising:

a case;

a pair of dielectric resonators contained in said case;

an external connector mounted to said case; and coupling means connected to said external connector and having respective portions electromagnetically coupled to said dielectric resonators;

wherein said coupling means includes a pair of adjusting mechanisms corresponding to said respective portions of said coupling means, for adjusting the electromagnetic coupling of said respective portions to said dielectric resonators;

said pair of adjusting mechanisms being composed of a main coupling plate and a respective pair of unitary loop-shaped branch plates separably attached thereto, said main and branch plates being made of a bendable sheet material for being bendable in order to adjust said coupling, and a pair of portions of said main plate which correspond respectively to said pair of adjusting mechanisms being unequal in length.

9. A dielectric resonator device, comprising:

a case;

a dielectric resonator contained in said case;

an external connector mounted to said case; and a coupling device connected to said external connector and electromagnetically coupled to said dielectric resonator;

wherein said coupling device includes an adjusting mechanism for adjusting the electromagnetic coupling of said coupling device to said dielectric resonator, said adjusting mechanism being composed of a main coupling plate and a unitary loop-shaped branch plate separably attached thereto, said main and branch plates being made of a bendable sheet material for being bendable in order to adjust said coupling.

10. A dielectric resonator device according to claim 9, wherein said adjusting mechanism comprises a predetermined portion of said coupling device having less rigidity than other portions of said coupling device.

11. A dielectric resonator device according to claim 10, wherein said predetermined portion is smaller in width than said other portions of said coupling device.

12. A dielectric resonator device according to claim 10, wherein said predetermined portion is smaller in thickness than said other portions of said coupling device.

13. A dielectric resonator device according to claim 10, wherein said predetermined portion is located adjacent a portion of said coupling device which is fixed to said dielectric resonator device.

14. A dielectric resonator device according to claim 9, wherein said adjusting mechanism is disposed for enabling said coupling device to bend toward and away from said dielectric resonator.

15. A dielectric resonator device according to claim 9, wherein said dielectric resonator device has a step integrally formed thereon for supporting said coupling device.

16. A dielectric resonator device, comprising:

a case;

a pair of dielectric resonators contained in said case;

an external connector mounted to said case; and a coupling device connected to said external connector and having respective portions electromagnetically coupled to said dielectric resonators;

wherein said coupling device includes a pair of adjusting mechanisms corresponding to said respective portions of said coupling device, for adjusting the electromagnetic coupling of said respective portions to said dielectric resonators;

said pair of adjusting mechanisms being composed of a main coupling plate and a respective pair of unitary loop-shaped branch plates separably attached thereto, said main and branch plates being made of a bendable sheet material for being bendable in order to adjust said coupling, and a pair of portions of said main plate which correspond respectively to said pair of adjusting mechanisms being unequal in length.

17. A dielectric resonator device according to claim 1, wherein said main coupling plate and said branch plate are separably attached together by at least a first fastener.

18. A dielectric resonator device according to claim 17, wherein a pair of fasteners including said first fastener are provided for separably attaching said branch plate to said main coupling plate at two respective locations along said branch plate.

19. A dielectric resonator device according to claim 18, wherein said loop-shaped branch plate is continuous so as to define a closed loop.

20. A dielectric resonator device according to claim 19, wherein said loop-shaped branch plate is quadrangular in shape.

21. A dielectric resonator device according to claim 19, wherein said main coupling plate is elongated in shape and defines a longitudinal axis, and said branch plate extends transversely away from said main coupling plate on both sides thereof.

22. A dielectric resonator device according to claim 1, wherein said loop-shaped branch plate is continuous so as to define a closed loop.

23. A dielectric resonator device according to claim 22, wherein said loop-shaped branch plate is quadrangular in shape.

24. A dielectric resonator device according to claim 22, wherein said main coupling plate is elongated in shape and defines a longitudinal axis, and said branch plate extends transversely away from said main coupling plate on both sides thereof.

25. A dielectric resonator device according to claim 9, wherein said main coupling plate and each said branch plate are separably attached together by at least a first fastener.

26. A dielectric resonator device according to claim 25, wherein a pair of fasteners including said first fastener are provided for separably attaching each said branch plate to said main coupling plate at two respective locations along said branch plate.

27. A dielectric resonator device according to claim 26, wherein each said loop-shaped branch plate is continuous so as to define a closed loop.

28. A dielectric resonator device according to claim 27, wherein said loop-shaped branch plate is quadrangular in shape.

29. A dielectric resonator device according to claim 27, wherein said main coupling plate is elongated in shape and defines a longitudinal axis, and each said branch plate extends transversely away from said main coupling plate on both sides thereof.

30. A dielectric resonator device according to claim 9, wherein each said loop-shaped branch plate is continuous so as to define a closed loop.

31. A dielectric resonator device according to claim 30, wherein said loop-shaped branch plate is quadrangular in shape.

32. A dielectric resonator device according to claim 30, wherein said main coupling plate is elongated in shape and defines a longitudinal axis, and each said branch plate extends transversely away from said main coupling plate on both sides thereof.

* * * * *